US005584709A

United States Patent [19]

Kiat

[11] Patent Number: 5,584,709

[45] Date of Patent: Dec. 17, 1996

[54] PRINTED CIRCUIT BOARD MOUNTED ELECTRICAL CONNECTOR

[75] Inventor: Toh S. Kiat, Singapore, Singapore

[73] Assignee: Molex Incorporated, Lisle, Ill.

[21] Appl. No.: 381,614

[22] Filed: Jan. 30, 1995

[51] Int. Cl.[6] ..... H01R 9/09

[52] U.S. Cl. ..... 439/79

[58] Field of Search ..... 439/79, 62

[56] References Cited

U.S. PATENT DOCUMENTS

| | | | |
|---|---|---|---|
| 4,652,066 | 3/1987 | Pelzl et al. | 439/17 |
| 4,653,837 | 3/1987 | Phillipson et al. | 439/143 R |
| 4,687,267 | 8/1987 | Header et al. | 439/62 |
| 4,722,691 | 2/1988 | Gladd et al. | 439/79 |
| 4,840,573 | 6/1989 | Seidel et al. | 439/92 |
| 5,065,236 | 11/1991 | Broeksteeg | 439/79 |
| 5,112,233 | 5/1992 | Lybrand | 439/79 |
| 5,199,886 | 4/1993 | Patterson | 439/79 |
| 5,281,165 | 1/1994 | McCleerey | 439/79 |

FOREIGN PATENT DOCUMENTS

| | | | |
|---|---|---|---|
| 8811877.0 | 12/1988 | Germany | H01R 9/09 |

*Primary Examiner*—Gary F. Paumen
*Assistant Examiner*—T. C. Patel
*Attorney, Agent, or Firm*—Charles S. Cohen

[57] ABSTRACT

An electrical connector includes an elongated dielectric housing adapted for mounting to a surface of a printed circuit board. The housing has terminal-receiving passages extending generally parallel to the circuit board between a front mating face of the housing and a rear terminating face thereof. The passages are arranged in pairs of upper and lower passages, with the passages in each pair being in a plane generally perpendicular to the circuit board. A plurality of terminals are mounted in pairs on the housing with mating portions in the passages and terminating portions projecting from the rear face of the housing for termination to circuit traces on the printed circuit board. The terminals are blanked from sheet metal material with the terminals in each pair being coplanar. The terminating portions have generally inverted U-shaped configurations, with the U-shaped terminating portion of a lower terminal in each pair thereof being nested within the U-shaped terminating portion of an upper terminal in each pair thereof.

49 Claims, 3 Drawing Sheets

PRINTED CIRCUIT BOARD MOUNTED ELECTRICAL CONNECTOR

FIELD OF THE INVENTION

This invention generally relates to the art of electrical connectors and, particularly, to an electrical connector for mounting to a printed circuit board.

BACKGROUND OF THE INVENTION

A wide variety of electrical connectors are designed for mounting to printed circuit boards. Such connectors conventionally include a dielectric housing, such as a unitarily molded plastic housing, adapted for mounting to one side of the board. The housing typically includes a front mating face for mating with a complementary connecting device and a rear terminating face from which a plurality of terminals exit the housing for termination to circuit traces on the printed circuit board. The terminals normally include mating portions for mating with the terminals of the complementary connecting device, and terminating or tail portions projecting from the housing for interconnection, as by soldering, to circuit traces on the board or in holes in the board into which the tails are inserted.

Some printed circuit board mounted electrical connectors are designed for mounting at an edge of the board. The connector housing has a mounting portion for mounting to a top surface of the board to define a seating plane for the connector. For instance, the main body portion of the connector housing may run along the edge of the board, with mounting ear portions of the housing projecting from the terminating face thereof for mounting to the top surface of the board. The tail portions of the terminals project from the housing, such as between the mounting ears projecting therefrom, for termination to the circuit traces on the board.

Problems continue to arise in designing electrical connectors of the character described above. These problems often are associated with the design and/or assembly of the terminals in the connector housing. For instance, difficulties arise in inserting the terminals into the connector housing because of the delicate nature of the tail portions of the terminals projecting from the rear terminating face of the housing. These tail portions may be very thin elements and insertion forces would tend to bend or break the tail portions. Therefore, many such electrical connectors employ stamped and formed terminals which are formed with various portions to facilitate insertion of the terminals into the connector housing. On the other hand, it would be desirable to be able to simply blank the terminals from sheet metal material, but blanked terminals heretofore designed do not facilitate efficient insertion of the terminals into the connector housing.

In addition, simple blanked terminals have a tendency to be relatively wasteful in the amount of sheet metal material required in the blanking process. The design of the terminals result in a considerable amount of sheet metal material going to waste after the terminals are fabricated.

Still further, the configuration of the terminating/tail portions of the terminals which project from the housing for interconnection to circuit traces on the printed circuit board, have not been amenable to high density arrays. The terminating or tail portions of the terminals simply require too much space at the rear face of the connector housing.

The present invention is directed to solving the various problems identified above and satisfying a need for a printed circuit board mounted electrical connector having an extremely compact terminal array which facilitates insertion of the terminals into the connector, the terminals being blanked of-sheet metal material in a very efficient, non-wasteful configuration.

SUMMARY OF THE INVENTION

An object, therefore, of the invention is to provide a new and improved circuit board mounted electrical connector of the character described above.

In the exemplary embodiment of the invention, the electrical connector includes an elongated dielectric housing adapted for mounting along an edge of a printed circuit board with a mounting portion of the housing being mounted to a top surface of the board to define a seating plane for the connector. The housing has terminal-receiving passages extending generally parallel to the seating plane between a front mating face of the housing and a rear terminating face thereof. The passages are arranged in pairs of upper and lower passages longitudinally along at least a portion of the housing. The passages in each pair are in a plane perpendicular to the seating plane.

A plurality of terminals are mounted in pairs on the housing, with mating portions in the passages and terminating portions projecting from the rear face of the housing for termination to circuit traces on the printed circuit board. The terminals are blanked from sheet metal material, with the terminals in each pair being coplanar. The terminating portions have generally inverted U-shaped configurations, with the U-shaped terminating portion of a lower terminal in each pair thereof being nested within the U-shaped terminating portion of an upper terminal in each pair thereof.

The mounting portion of the housing may be located at a position for effectively locating the seating plane of the connector above the centerline of the lower passages in the pairs thereof.

The U-shaped terminating portions of the terminals define an inner leg, an outer leg and a bridge portion of each terminating portion of each terminal. In the preferred embodiment of the invention, the inner legs are located in a recessed area in the rear terminating face of the housing. A shoulder is formed on the underside of each bridge portion of each upper terminal to facilitate insertion of the terminals into their respective passages. The outer legs form solder tails, with the tips of the solder tails being located in proximity to a plane defined by the bottom edge of the lower terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
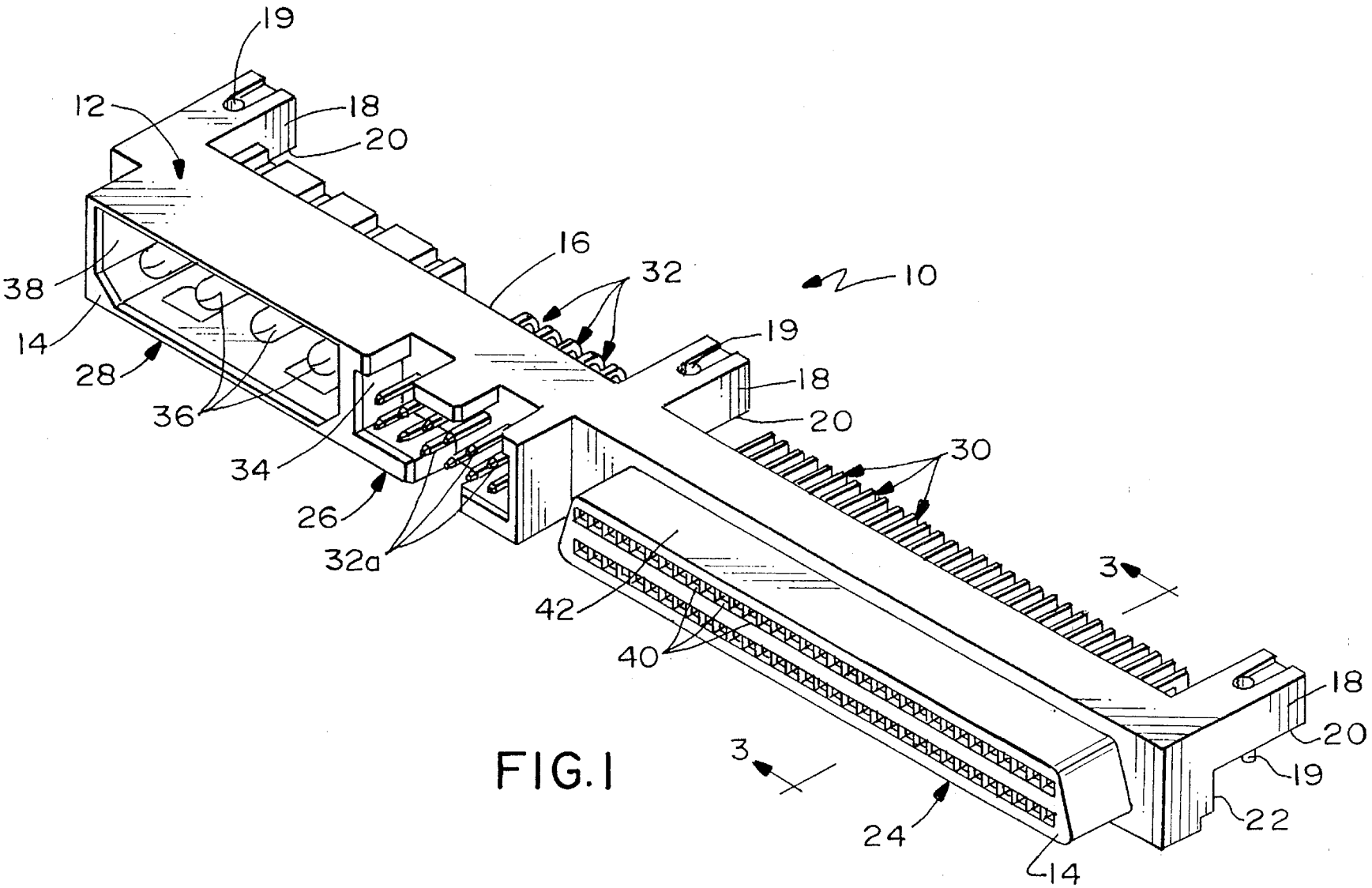
FIG. 1 is a perspective view of an electrical connector embodying the concepts of the invention.

Referring to the drawings in greater detail, and first to FIG. 1, the invention is embodied in an electrical connector, generally designated 10, which includes an elongated dielectric housing, generally designated 12, adapted for mounting along an edge of a printed circuit board, as will be seen hereinafter. Housing 12 includes a front mating face 14 and a rear terminating face 16 and three mounting ears 18 project rearwardly of the terminating face for mounting to a top surface of the printed circuit board. Pins 19 project through ears 18 and into appropriate holes in the printed circuit board. Bottom surfaces 20 of mounting ears 18 engage the top surface of the board. In addition, connector 10 is adapted for mounting along an edge 44*c* (FIG. 3) of the printed circuit board. To that end, housing 12 includes a rear surface 22 for engaging the edge of the board. The rear surface 22 is coplanar with rear face 16. The housing is unitarily molded of dielectric material such as plastic or the like.

At this point, it should be understood that such terms as "top", "bottom", "upper" and "lower" are used herein to provide a clear and concise description of the invention as viewed in the drawings. However, the use of such terms herein and in the claims hereof are not intended in any way to be limiting, because it is known that printed circuit board mounted electrical connectors, as well as the printed circuit boards themselves, are omnidirectional in actual practice or use. Still referring to FIG. 1, electrical connector 10 is a combination connector which includes three sections spaced lengthwise of the connector and generally designated 24, 26 and 28. Section 24 will be termed the data section of the connector and includes a plurality of terminals 30 embodying the concepts of the invention. Section 26 will be termed the options section of the connector and includes a plurality of right-angled terminals 32 having pin portions 32*a* disposed in a center recessed area 34 in mating face 14 of housing 12 for mating with terminals of a complementary connecting device or mating connector (not shown). Section 28 will be termed the power section of the connector and includes four large formed terminals 36 located in an end recessed area 38 in mating face 14 of housing 12 for mating with the power terminals of the complementary mating connector. As will be described below, terminals 30 of data section 24 have mating portions (not visible in FIG. 1) extending into terminal-receiving passages 40 in a "D-shaped" projecting portion 42 of housing 12 for insertion into a complementary D-shaped receptacle of the complementary connecting device.

Figure 2:
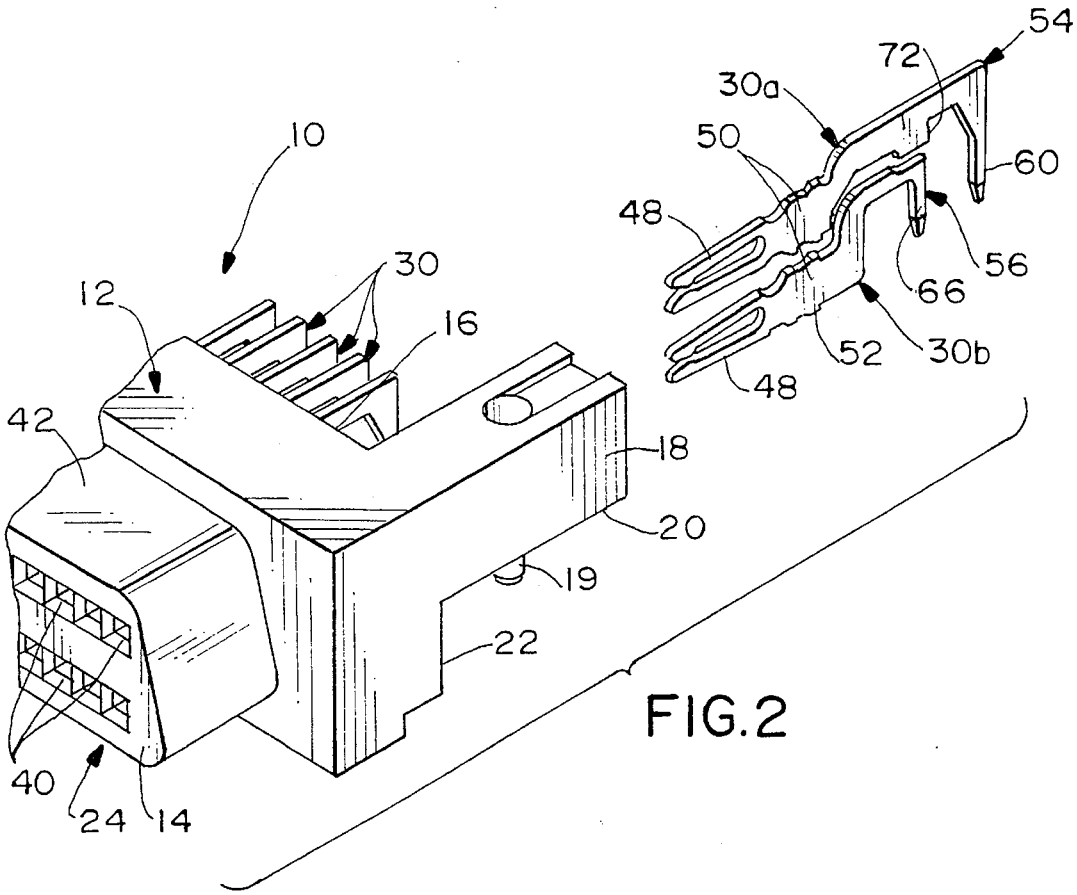
FIG. 2 is an enlarged perspective view of the right-hand end of the connector shown in FIG. 1, with a pair of the terminals removed to facilitate an illustration thereof.

Referring to FIG. 2 and as described in greater detail hereinafter, terminals 30 in data section 24 of connector 10 are arranged in pairs of upper and lower terminals, generally designated 30*a* and 30*b*, respectively, longitudinally along connector housing 12. One pair of the terminals 30*a* and 30*b* are removed from the housing in FIG. 2 to facilitate the illustration thereof. It can be seen quite clearly in FIG. 2 that the terminals are blanked terminals, i.e., blanked from sheet metal material rather than stamped and then formed into a shape out of the plane of the sheet metal material. The terminals in each pair also are quite clearly seen to be coplanar and are in that relationship when inserted into connector housing 12.

Figure 3:
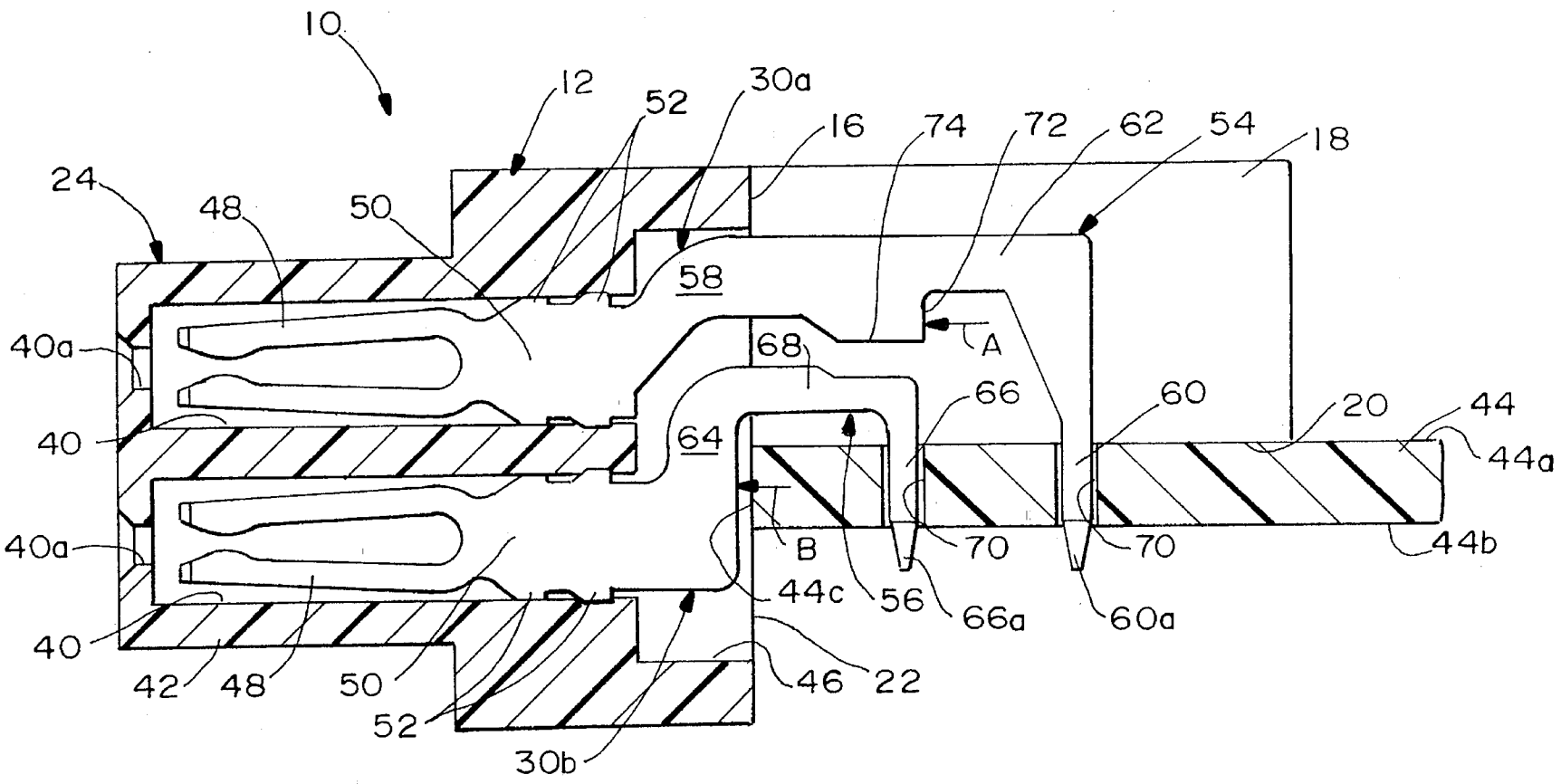
FIG. 3 is a vertical section, on an enlarged scale, taken generally along line 3—3 of FIG. 1.

Referring to FIG. 3 in conjunction with FIGS. 1 and 2, connector 10 is shown to be mounted to a printed circuit board 44 having a top surface 44*a* and a bottom surface 44*b*. The bottom surface 20 of mounting ears 18 are shown engaged with top surface 44*a* of the printed circuit board, while rear surface 22 (i.e., rear terminating face 16) of connector housing 12 is in edge engagement or with an edge 44*c* of the printed circuit board. Bottom surface 20 of mounting ears 18 define the "seating plane" of connector 10 on circuit board 44. Terminal-receiving passages 40 can be seen clearly in FIG. 3 to extend generally parallel to the seating plane, with the passages extending between the front mating face and the rear terminating face of connector housing 12. Actually, the passages have front entry areas 40*a* of reduced size for receiving mating terminal pins of the complementary mating connector. The passages open into a recessed area 46 in terminating face 16 of the connector housing. Finally, passages 40 are arranged in pairs of upper and lower passages extending longitudinally along data section 24 of the connector, with the passages in each pair being in a plane perpendicular to the seating plane defined by bottom surface 20 of mounting ears 18.

Upper and lower terminals 30*a* and 30*b*, respectively, have substantially identical bifurcated mating portions 48 projecting from body portions 50 within their respective passages 40 toward entry areas 40*a* for mating with the terminal pins of the complementary mating connector. Body portions 50 of the terminals have barbs 52 for press fitting into the plastic material of housing 12 within passages 40.

Generally, upper and lower terminals 30*a* and 30*b*, respectively, have terminating portions 54 and 56, respectively, which have generally inverted U-shaped configurations. It can be seen in both FIGS. 2 and 3 that the U-shaped terminating portion 56 of lower terminal 30*b* is nested within the U-shaped terminating portion 54 of upper terminal 30*a*.

U-shaped terminating portion 54 of upper terminal 30a defines an inner leg 58, an outer leg or tail 60 and a bridge portion 62 joining the legs. U-shaped terminating portion 56 of lower terminal 30*b* has an inner leg 64, an outer leg or tail 66 and a bridge portion 68 joining the legs. Inner legs 58 and 64 of the terminating portions of the upper and lower terminals may be located in recessed area 46 in rear terminating face 16 of connector housing 12.

Outer legs 60 and 66 of terminating portions 54 and 56, respectively, of upper and lower terminals 30*a* and 30b, respectively, define solder tails for the respective terminals. The solder tails project downwardly into holes 70 in printed circuit board 44 to ultimately be soldered to appropriate circuit traces in the holes.

Figure 4:
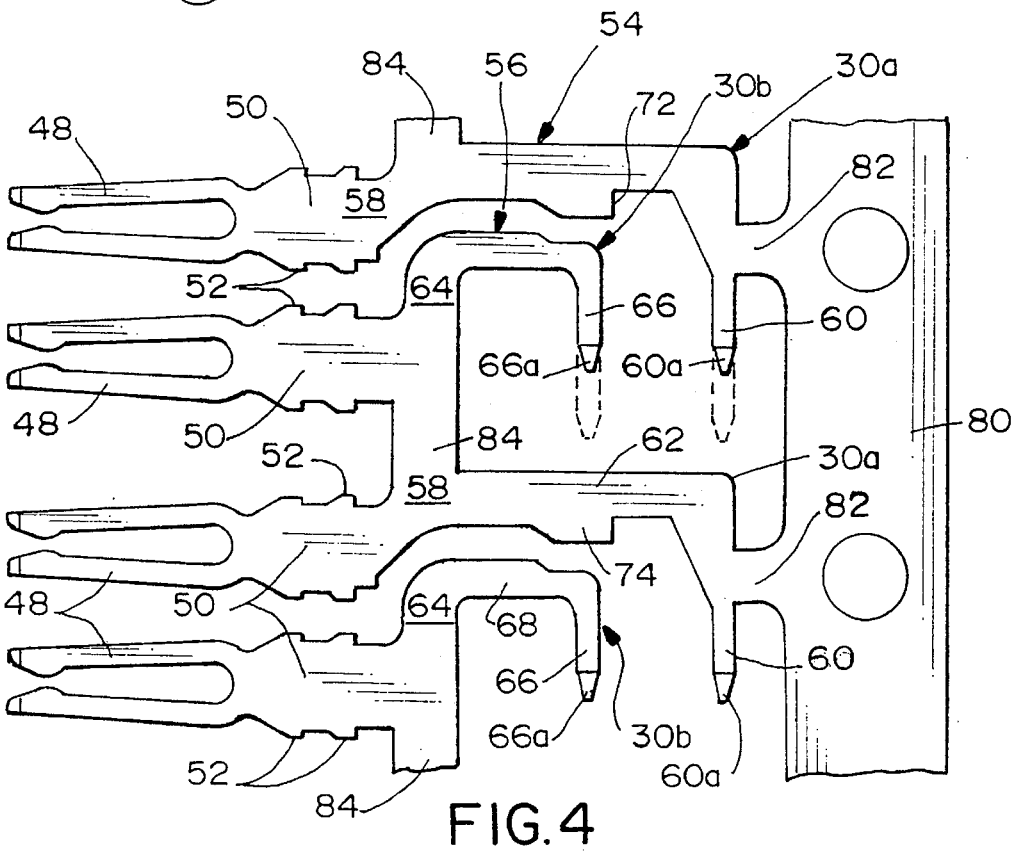
FIG. 4 is a plan view of two pairs of terminals as blanked from a sheet of metal material, but with the terminals still joined to a carrier strip of the sheet.

In practice, the length of solder tails 60 and 66 may be increased or reduced and may extend significantly downward past lower barbs 52 of terminal 30*b*, as shown in phantom in FIG. 4, so long as there is sufficient clearance between tips 60*a* and 66*a* of tails 60 and 66, respectively, and the top of bridge 62. This distance is affected by the length of web 84. This saves material during the blanking process of the terminals, as described hereinafter.

A shoulder 72 is formed by a tab 74 projecting downwardly from the underside of bridge portion 62 of upper terminal 30*a* to define a means against which the terminal can be pushed or inserted into passages 40 in connector housing 12. Insertion forces are directed against upper terminal 30*a* as indicated by arrow "A" and against lower terminal 30*b* as indicated by arrow "B" to insert the terminals into the passages of the connector housing by a "stitching" type of insertion process. Therefore, insertion forces are not applied to the delicate tail portions 60 and 66 of the terminals, thereby avoiding the possibility of damaging or misaligning those small, fragile elements of the terminals.

Lastly, FIG. 4 shows two pairs of terminals 30*a* and 30*b* as stamped from a blank of sheet metal material. It can be seen that terminals 30*a* still are joined to a carrier strip 80 by webs 82 which carry the terminals through the stamping operations. Terminal 30*b* of a first set of terminals is joined to terminal 30*a* of a second set of terminals by webs 84. Webs 82 and 84 eventually are severed so that the terminals can be stitched in pairs (see terminals 30*a* and 30*b* in FIG. 2) into passages 40 of connector housing 12 from rear terminating face 16 of the housing. FIG. 4 shows how closely the terminals are located in the sheet of metal material during fabrication. This disposition of the terminals is afforded by nesting the U-shaped terminating portion 56 of the lower terminal within the U-shaped terminating portion 54 of the upper terminals. Material is saved by closely spacing the pairs of terminals. As seen clearly in FIG. 4, the lower terminals 30*b* in each pair thereof are located quite closely to the upper terminals 30*a* of the next pair, joined only by small webs 84, to thereby minimize the amount of sheet metal material wasted between the pairs during blanking of the terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector, comprising:

an elongated dielectric housing adapted for mounting along an edge of a printed circuit board with a mounting portion of the housing being mounted adjacent a top surface of the board to define a seating plane for the connector, the housing having terminal-receiving passages extending generally parallel to said seating plane between a front mating face of the housing and a rear terminating face thereof, the passages being arranged in pairs of the upper and lower passages longitudinally along at least a portion of the housing, with the passages it each pair being in a plane generally perpendicular to said seating plane; and a plurality of terminals mounted in generally coplanar pairs on the housing each terminal including a mating portion in one of said passages and a generally inverted U-shaped terminating portion projecting rearwardly of said one said passages for termination to a circuit trace on the printed circuit board, the terminating portion blanked from generally planar sheet metal material and having stamped edges generally perpendicular to the plane of said sheet metal material and a pair of generally parallel to between said stamped edges and oriented generally parallel to the plane of the sheet metal material, the U-shaped terminating portion of a lower terminal in each pair thereof being nested within the U-shaped terminating portion of an upper terminal in each pair thereof, and each said inverted U-shaped terminating portion defining an inner leg generally adjacent said rear terminating face, an outer leg generally parallel to said inner leg and a bridge portion extending between an inner and outer legs, the major surfaces of the bridge portion being generally perpendicular to the seating plane and the mounting portion of the housing being positioned for locating the seating plane above a lowest extremity of the mating portion of the lower terminal.

2. The electrical connector of claim 1 wherein said inner legs are located in a recessed area generally adjacent the rear terminating face of the housing.

3. The electrical connector of the claim 1 wherein the outer legs form solder tails with tips of the solder tails being located in proximity to a plane defined by a lowest extremity of the lower terminal.

4. The electrical connector of the claim 1 wherein an upper stamped edge of each bridge is located above the mating portion of its respective terminal.

5. The electrical connector of the claim 1 wherein the bridge of each terminal is space from the housing.

6. The electrical connector of claim 1 wherein the outer leg of each terminal is unsupported by the housing.

7. The electrical connector of the claim 1 wherein the bridge of each lower terminal is spaced from the housing.

8. The electrical connector of claim 1 wherein said mating portion of each terminal is a female contact having a pair of space apart resilient beams.

9. The electrical connector of claim 1 wherein each terminal further includes a terminal securing section for securing said terminals within said passages.

10. The electrical connector of claim 1 wherein said mounting portion of the housing is located at a position for effectively locating said seating plane above the centerline of the lower passages in said pairs thereof.

11. The electrical connector of claim 10 wherein said inner legs are located in a recessed area generally adjacent the rear terminating face of the housing.

12. The electrical connector of the claim 10 further including a shoulder formed on an underside of the bridge portion of each upper terminal to facilitate insertion of the terminals into their respective passages.

13. The electrical connector of claim 10 wherein the outer legs form solder tails with tips of the solder tails being located in proximity to a plane defined by a lowest extremity of the lower terminal.

14. The electrical connector of claim 1 further including a shoulder formed on an underside of the bridge portion of each upper terminal to facilitate insertion of the terminals into their respective passages.

15. The electrical connector of the claim 14 wherein said shoulder is generally aligned with the mating portion of said terminal.

16. The electrical connector of claim 14 wherein said shoulder projects downward from said bridge.

17. The electrical connector of the claim 14 wherein said shoulder is generally adjacent a midpoint of the said bridge.

18. The electrical connector of claim 17 wherein said shoulder is generally adjacent the outer leg of said lower terminal to provide access to said shoulder from below and between the outer legs of said upper and lower terminals.

19. The electrical connector of claim 14 further comprising a push surface on a surface of the inner leg of said lower terminal facing the outer leg thereof.

20. The electrical connector of the claim 19 wherein the shoulder of said upper terminal is generally aligned with one of said upper passages and the push surface of said lower terminal is generally aligned with one of said lower passages.

21. An electrical connector, comprising:

an elongated dielectric housing adapter for mounting along an edge of a printed circuit board with a mounting portion of the housing being mounted adjacent a top surface of the board to define a seating plane for the connector, the housing having terminal-receiving passages extending generally parallel to said seating plane between a front mating end of the housing and a rear terminating end thereof, the passages being arranged in pairs of upper and lower passages logitudinally along at least a portion of the housing, with the passages in each pair being in a plane generally perpendicular to said seating plane, the seating plane being located above a lowermost surface of the lower passages; and a plurality of terminals mounted in generally coplanar pairs in the housing, each terminal including a terminal retention portion for retaining the terminal in the housing, a mating portion projecting from a first end of the retention portion, said mating portion having a pair of spaced apart resilient beams, and a generally inverted U-shaped rear portion projecting from a second opposite end of said retention portion for termination to a circuit trace on the printed circuit board, the rear portion being blanked from generally planer sheet metal material and having stamped edges generally perpendicular to the plane of said sheet metal material and a pair of generally parallel major surfaces between said stamped edges and oriented generally parallel to the plane of the sheet metal material, the U-shaped terminating portion of a lower terminal in each pair thereof being nested within the U-shaped terminating portion of an upper terminal in each pair thereof, and each said inverted U-shaped terminating portion including an inner leg extending upwardly from said retention portion, an outer leg generally perpendicular to said seating plane and a bridge portion extending between said inner and outer legs, the major. surfaces of the bridge portion being generally perpendicular to the seating plane.

22. The electrical connector of claim 21 wherein said seating plane is positioned above the centerline of the lower passages in said pairs thereof.

23. The electrical connector of claim 21 wherein said inner legs are located in a recessed area generally adjacent the rear terminating and of the housing.

24. The electrical connector of claim 21 wherein a top surface of each bridge is located above the mating portion of its respective terminal.

25. The electrical connector of the claim 21 further comprising a push surface on a lower portion of the bridge of said upper terminal.

26. The electrical connector of claim 25 wherein said push surface is generally aligned with the mating portion of said upper terminal.

27. The electrical connector of claim 25 wherein said push surface is on shoulder projecting downward.

28. The electrical connector of claim 25 wherein said push surface is generally adjacent a horizontal midpoint of said bridge.

29. The electrical connector of claim 28 wherein said push surface is generally adjacent the outer leg of said lower terminal to provide access to said upper and lower terminals.

30. The electrical connector of claim 25 further comprising a push surface on a stamped edge of the inner leg of said lower terminal facing the outer leg thereof.

31. The electrical connector of claim 21 wherein outer leg of each terminal is spaced from the housing.

32. The electrical connector of claim 31 wherein the bridge of each terminal is also spaced from the housing.

33. An electrical connector, comprising:

an elongated dielectric housing adapted for mounting along an edge of a printed circuit board with a mounting portion of the housing being mounted adjacent a top surface of the board to define a seating plane for the connector, the housing having terminal-receiving passages extending generally parallel to said seating plane along a mating axis, the passages being arranged longitudinally along at least a portion of the housing; and a plurality of terminals mounted in generally coplanar pairs in the housing, the plane of each pair of terminals being generally perpendicular to said seating plane, each terminal including a mating portion, a securing section for securing the terminal in the housing and a generally inverted U-shaped terminating portion for terminating portion for termination to a circuit trace on the printed circuit board, the terminating portion being blanked from generally planer sheet metal material and having stamped edges generally perpendicular to the plane of said sheet metal material and a pair of generally parallel major surfaces between said stamped edges and oriented generally parallel to the plane of the sheet metal material, the U-shaped terminating portion of a lower terminal in each pair thereof being nested within the U-shaped terminating portion of an upper terminal in each pair thereof, and each said inverted U-shaped terminating portion including an inner leg, an outer leg generally parallel to said inner leg and a bridge portion extending between said inner and outer legs, the major surfaces of the bridge portion being generally perpendicular top the seating plane, the seating plane being located above a horizontal plane generally extending through a lowermost portion of each of the lower terminals, an uppermost portion of the bridge of said lower terminals being above a lowermost portion of one of said mating portion and said securing portion of said upper terminals.

34. The electrical connector of claim 33 wherein said inner leg of each lower terminal extends upwardly from said retention portion to said bridge portion.

35. The electrical connector of claim 33 wherein the mating portion of each terminal has a pair of spaced apart resilient beams.

36. The electrical connector of claim 33 wherein a top surface of the bridge of each lower terminal is located above the mating portion of its respective terminal.

37. The electrical connector of claim 30 wherein the push surface of said upper terminal is generally aligned with one of said upper passages and the push surface of said lower terminal is generally aligned with one of said lower passages.

38. The electrical connector of claim 37 further comprising a push surface on a lower portion of the bridge of said upper terminal.

39. The electrical connector of claim 38 wherein said push surface is generally aligned with the mating portion of said upper terminal.

40. The electrical connector of claim 38 wherein said push surface is generally adjacent a horizontal midpoint of said bridge.

41. The electrical connector of claim 38 wherein said push surface is generally adjacent the outer leg of said lower terminal to provide access to said push surface from below and between the outer legs of said upper and lower terminals.

42. The electrical connector of claim 38 wherein said push surface is on a shoulder projecting downward.

43. The electrical connector of claim 38 further comprising a push surface on a stamped edge of the inner leg of said lower terminal facing the outer leg thereof.

44. The electrical connector of claim 43 wherein the push surface of said upper terminal is generally aligned with one of said upper passages and the push surface of said lower terminal is generally aligned with one of said lower passages.

45. The electrical connector of claim 33 wherein the outer leg of each terminal is unsupported by the housing.

46. The electrical connector of claim 45 wherein the bridge of each terminal is also spaced from the housing.

47. A method of manufacturing an electrical connector, comprising the steps of:

Providing an elongated dielectric housing adapted for mounting along an edge of a printed circuit board with a mounting portion of the housing being mounted adjacent a top surface of the board to define a seating plane for the connector, the housing having terminal-receiving recesses extending generally parallel to said seating plane between a front mating end of the housing and a rear terminating end thereof, the recesses being arranged in pairs of upper end lower recesses longitudinally along at least a portion of the housing, with the recesses in each pair being in a plane generally perpendicular to said seating plane, the seating plane being positioned above a centraline of the lower recesses;

stamping from generally planar sheet metal material a plurality of terminals oriented in nested coplanar pair of upper and lower terminals, each terminal including a mating portion and a generally inverted U-shaped terminating portion projecting rearwardly or said mating portion for termination to circuit traces on the printed circuit board, the stamping step forming stamped edges on said terminating portion generally perpendicular to the plane of said sheet metal material and a pair of generally parallel major surfaces between the stamped edges and oriented generally parallel to the plane of the sheet metal material, the U-shaped terminating portion of each said lower terminal in each pair of one of said upper terminal in each pair thereof, and each said inverted U-shaped terminating portion defining an inner leg generally adjacent said rear terminating end, an outer leg generally parallel to said inner leg and a bridge portion extending between said inner and outer legs;

simultaneously inserting the mating portions of each pair upper and lower terminals into one said pairs of upper and lower recesses, the major surfaces of each bridge portion being generally perpendicular to the seating plane; and repeating said simultaneous inserting step until a desired predetermined number of pair of terminals have been inserted into the housing.

48. The method of claim 47 wherein said simultaneous inserting step includes applying an insertion force to a push surface on a surface of the bridge of said upper terminal within said inverted U-shaped terminating portion.

49. The method of claim 48 wherein said simultaneous inserting step further includes applying an insertion force to a push surface on an inner surface of the inner leg of said lower terminal facing the outer leg thereof.

* * * * *